US009039387B2

(12) United States Patent
Mellar

(10) Patent No.: US 9,039,387 B2
(45) Date of Patent: May 26, 2015

(54) SUPERCHARGED COMPRESSOR AND METHOD FOR CONTROLLING A SUPERCHARGED COMPRESSOR

(75) Inventor: Joerg Mellar, Pliening (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 112 days.

(21) Appl. No.: 12/769,370

(22) Filed: Apr. 28, 2010

(65) Prior Publication Data

US 2010/0269799 A1 Oct. 28, 2010

Related U.S. Application Data

(63) Continuation of application No. PCT/EP2008/008880, filed on Oct. 21, 2008.

(30) Foreign Application Priority Data

Oct. 29, 2007 (DE) ..... 10 2007 051 940

(51) Int. Cl.
*F04B 49/16* (2006.01)

(52) U.S. Cl.
CPC ..... *F04B 49/16* (2013.01); *F04B 2201/0808* (2013.01); *F04B 2205/03* (2013.01)

(58) Field of Classification Search
USPC ..... 417/275, 277, 213
See application file for complete search history.

(56) References Cited

U.S. PATENT DOCUMENTS

| | | | | |
|---|---|---|---|---|
| 1,579,781 | A * | 4/1926 | Riesner | 417/253 |
| 1,625,681 | A * | 4/1927 | Prellwitz | 417/275 |
| 2,261,911 | A * | 11/1941 | Condit | 417/275 |
| 3,972,652 | A * | 8/1976 | Minnicino | 417/277 |
| 4,085,921 | A * | 4/1978 | Ueda et al. | 251/129.08 |
| 4,384,826 | A * | 5/1983 | Gregg | 417/53 |
| 4,498,848 | A | 2/1985 | Petrovsky et al. | |
| 4,502,844 | A * | 3/1985 | Kimura et al. | 417/275 |
| 5,503,537 | A * | 4/1996 | Schlossarczyk et al. | 417/296 |
| 6,257,838 | B1 * | 7/2001 | Schlossarczyk et al. | 417/280 |
| 6,261,068 | B1 | 7/2001 | Kramer et al. | |
| 6,945,062 | B2 * | 9/2005 | Chen et al. | 62/228.5 |
| 2002/0025263 | A1 * | 2/2002 | Graziani et al. | 417/390 |
| 2007/0240436 | A1 * | 10/2007 | Landers et al. | 62/157 |

FOREIGN PATENT DOCUMENTS

| | | |
|---|---|---|
| AT | 152717 | 3/1938 |
| AT | 265498 | 10/1968 |

(Continued)

OTHER PUBLICATIONS

German Office Action dated Oct. 19, 2009 including English-language translation (Six (6) pages).

(Continued)

*Primary Examiner* — Devon Kramer
*Assistant Examiner* — Christopher Bobish
(74) *Attorney, Agent, or Firm* — Crowell & Moring LLP

(57) ABSTRACT

A supercharged compressor and method of operating the compressor supplies a commercial vehicle with compressed air. The compressor includes a piston chamber, a dead space or clearance volume and a valve unit for switching the clearance volume. The valve element is configured such that the air volume supplied by the supercharged compressor can be reduced to a value that is different from zero by activating the clearance volume.

13 Claims, 5 Drawing Sheets

(56) References Cited

FOREIGN PATENT DOCUMENTS

| | | | |
|---|---|---|---|
| DE | 2 000 009 | | 7/1971 |
| DE | 32 11 598 | A1 | 11/1983 |
| DE | 43 21 013 | A1 | 1/1995 |
| DE | 199 32 433 | A1 | 1/2000 |
| DE | 198 48 217 | A1 | 4/2000 |
| DE | 198 50 269 | A1 | 5/2000 |
| GB | 1 334 394 | | 10/1973 |
| JP | 49-33048 | | 9/1974 |
| JP | 4-087817 | A | 3/1992 |

OTHER PUBLICATIONS

International Search Report dated Feb. 24, 2009 including English-language translation (Six (6) pages).
German translation of Japanese Office Action mailed Feb. 4, 2013 and English Machine translation thereof.
Korean Office Action dated Aug. 28, 2014, with English Translation (seven (7) pages).

* cited by examiner

SUPERCHARGED COMPRESSOR AND METHOD FOR CONTROLLING A SUPERCHARGED COMPRESSOR

CROSS-REFERENCE TO RELATED APPLICATIONS

This application is a continuation of PCT International Application No. PCT/EP2008/008880, filed Oct. 21, 2008, which claims priority under 35 U.S.C. §119 from German Patent Application No. DE 10 2007 051 940.2, filed Oct. 29, 2007, the entire disclosures of which are herein expressly incorporated by reference.

BACKGROUND AND SUMMARY OF THE INVENTION

The invention refers to a charged compressor for compressed air supply of a commercial vehicle, with a piston chamber, a dead space and a valve unit for engaging the dead space.

The invention furthermore refers to a method for controlling a charged compressor for compressed air supply of a commercial vehicle, with a piston chamber, a dead space and a valve unit for engaging the dead space.

Modern commercial vehicles often have compressed air-operated sub-systems such as a compressed air-operated service brake and pneumatic suspension, which is why a compressed air supply unit, which includes a compressor, is customarily integrated into the commercial vehicle. Furthermore, the commercial vehicle normally has an internal combustion engine which for efficiency reasons is often equipped with a turbocharger.

There are basically now two different possibilities for the compressor for taking in ambient air. One possibility is to induct uncompressed air upstream of the turbocharger, wherein ambient air can also be simply inducted, whereas the other possibility is to branch off already precompressed air downstream of the turbocharger, and ideally downstream of a charge-air cooler which is associated with the turbocharger. As a result of inducting air which is already compressed by the turbocharger, a greatly increased air throughput ensues in the compressor, especially at higher engine speeds and high engine loads. At low engine speeds, however, an increased air delivery can barely be established. The typical turbocharger designs, which at low engine speeds and low loads build up hardly any useful charging pressure, are responsible in this case.

It is furthermore disadvantageous that very large valves are required inside the compressor in order to be able to cope with the high volumetric flows which occur at high charging pressures. When using conventional valves, peak pressures of 20 to 30 bar can occur, which lie significantly above the peak pressures of 12 to 18 bar which occur without turbocharging. Alternatively, it is possible to reduce the maximum compression of the compressor by use of a permanently available dead space which, however, has a disadvantageous effect upon the air delivery of the compressor, especially in the case of low charging pressure, and would further reduce the air delivery in this range. Furthermore, it is to be noted that the commercial vehicle often has an increased air requirement at low engine speeds. Container change operation and stopping-point air requirements of a bus, are examples of where there is an increased air requirement at low engine speeds.

The invention is based on the object of providing a charged compressor which minimizes or eliminates the stated disadvantages.

This and other objects are achieved by a charged compressor for compressed air supply of a commercial vehicle with a piston chamber, a dead. space, and a valve unit for engaging the dead space. The valve unit is formed such that the air volume which is delivered by the charged compressor can be reduced to a value which differs from zero by engaging the dead space.

Advantageous designs and developments of the invention are also described herein.

The invention builds on the generic-type charged compressor by forming the valve unit such that the air volume, which is delivered by the charged compressor, can be reduced to a value which differs from zero by engaging the dead space. By engaging (utilizing or activating) the dead space and reducing the delivered air volume which is associated with it, the peak pressures inside the charged compressor, which occur during a compression phase, are reduced. The valves can therefore be designed for lower volumetric flows, wherein at the same time a permanently available dead space can be dispensed with. Furthermore, the components of the crank drive can remain largely unreinforced.

Provision can advantageously be made in this case for the valve unit to include a plurality of valves which can be individually operated. The engaging of the dead space is customarily carried out by operating a valve unit which opens a connection between the piston chamber and the dead space in the form of a defined valve cross section. Via this defined valve cross section, the charged compressor breathes air into the dead space during the compression phase. In addition to the dead space volume, the valve cross section of the opened connection is of significance since this determines the flow resistance for the air. A plurality of valves which can be individually operated therefore enable an increasing of the valve cross section which is adapted to the charging pressure, or a reducing of the flow resistance.

Furthermore, provision can beneficially be made for the dead space to include a plurality of separate volumes which can be individually engaged by the valve unit. The engaging of a further dead space volume enables a further reduction of the peak pressures which occur in the charged compressor, if required.

Alternatively, provision can be made for the valve unit to include a valve which can be operated in at least two stages. Also, with a valve which can be operated in at least two stages, the opened valve cross section between the piston chamber and the dead space can be adjusted in a need-based manner, which is why in this way the peak pressures which occur in the charged compressor can also be reduced in stages.

Provision can especially be made for the air volume, which is delivered by the charged compressor, to be reduced to zero by engaging the dead space. If the valve cross section between the piston chamber and the dead space which can be opened by the valve unit is large enough, and at the same time the volume of the dead space is sufficient, then the delivery pressure which can be achieved by the charged compressor can be lowered below the pressure which is required for delivery of an air volume. In this state, the charged compressor delivers no more air volume and correspondingly requires less energy since it performs less work. In this way, a system for energy economy can be realized.

Furthermore, provision can be made for a clutch, which is associated with the charged compressor, to be suitable for disengaging the charged compressor from the engine. As a result of the total breaking of the connection between compressor and engine, the air delivery, and the load of the compressor which is related to it, is reduced to zero.

The inventive method reduces the air volume, which is delivered by the charged compressor, to a value which differs from zero by engaging the dead space. In this way, the advantages and characteristics of the compressor according to the invention are also put into effect within the scope of a method. This also applies to the especially preferred embodiments of the method according to the invention which are disclosed in the following.

This is usefully developed by the delivered air volume being influenced by changing an altogether open valve cross section of the valve unit between the dead space and the piston chamber.

Furthermore, provision can be made for the air volume, which is delivered by the charged compressor, being reduced to zero by engaging the dead space. Provision can also usefully be made for at least one condition for engaging the dead space being fulfilled only during an acceleration phase of the commercial vehicle.

Provision can especially be made for the engaging of the dead space to be carried out in dependence upon at least one of the following values: engine speed, turbocharger speed, charging pressure of the turbocharger, engine load, and air requirement of the commercial vehicle.

The charging pressure of the turbocharger or the turbocharger speed, or the engine speed and the engine load, may be used as a decision base as to whether engaging the dead space for lowering peak pressures, which occur in the charged compressor, is advisable. Furthermore, the air requirement of the commercial vehicle can be used as a criterion for engaging the dead space. If the commercial vehicle has sufficient compressed air, the charged compressor can be transferred into an energy-economizing state independently of other values.

Provision can advantageously be made for a clutch, which is associated with the compressor, to be engaged to disengage the compressor from the engine. In this case provision is usefully made for at least one condition for engaging the clutch to be fulfilled only during an acceleration phase of the commercial vehicle.

Provision can especially be made for the engaging of the clutch to be carried out in dependence upon at least one of the following values: engine speed, turbocharger speed, charging pressure of the turbocharger, engine load, and air requirement of the commercial vehicle.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
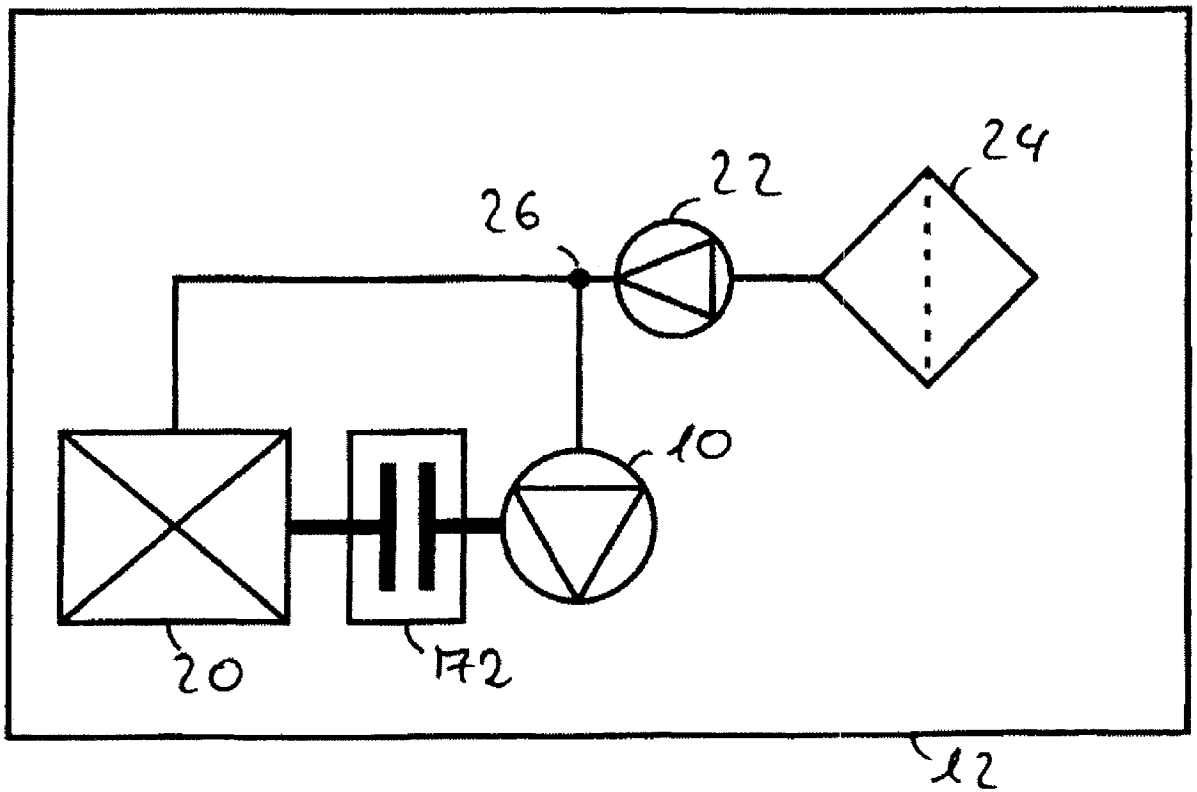
FIG. 1 is a schematically simplified view of a vehicle with a charged compressor.

In the following, like designations in the drawings refer to the same or similar components.

FIG. 1 shows a schematically simplified view of a vehicle 12 with a charged compressor 10. The commercial vehicle 12 is driven by the engine 20, the exhaust gas flow of which drives a turbocharger 22. Via an air filter 24, the turbocharger 22 inducts fresh air which is fed to the engine 20 with a charging pressure dependent upon the mass flow of the engine exhaust gas. The charged compressor 10 is also supplied with fresh air via a junction point 26, wherein this junction point 26 is arranged downstream (from the fresh air induction) of the turbocharger 22. A charge-air cooler (not shown) may be additionally arranged between the junction point 26 and the turbocharger 22, which recools the air which is precompressed by the turbocharger 22. Furthermore, a clutch 72 is associated with the compressor 10 and is arranged between the engine 20 and the compressor 10. By opening the clutch 72, the compressor 10 can be disengaged from the engine 20.

Figure 2:
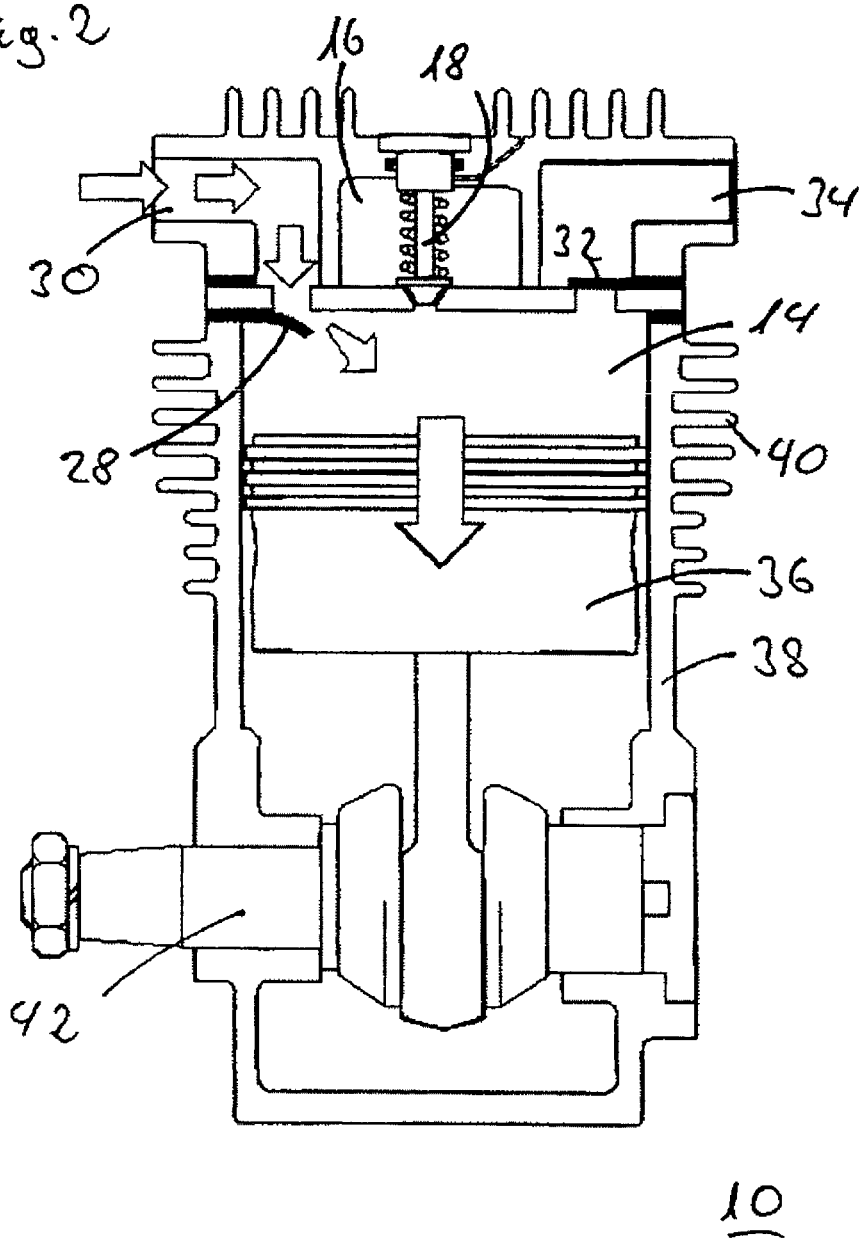
FIG. 2 is a sectional view of a compressor.
Figure 5:
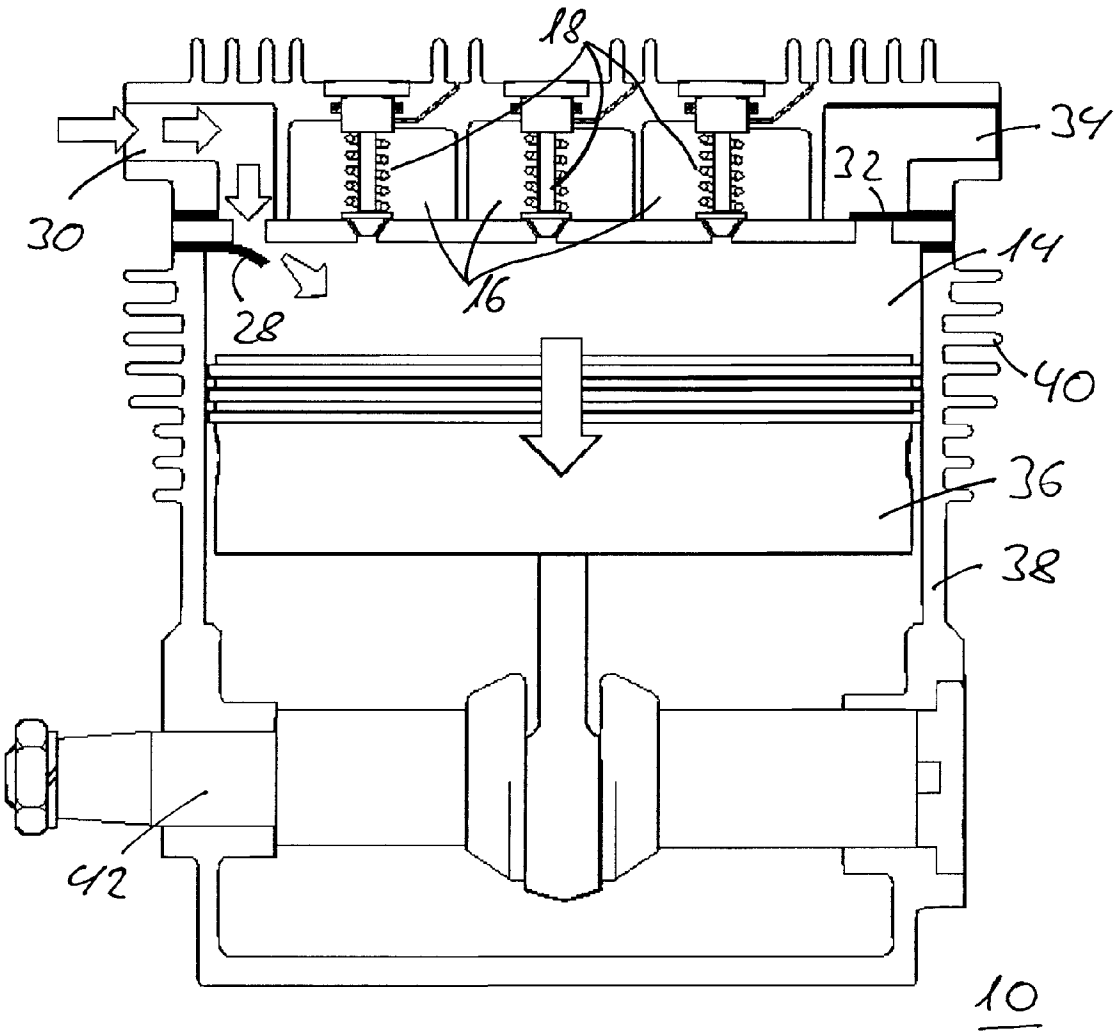
FIG. 5 is a sectional view of a compressor with plurality of individual valves.

FIG. 2 shows a sectional view of a compressor 10. The compressor 10 includes a cylinder case 38, with cooling ribs 40, which encloses a piston 36. The piston 36 moves in a piston chamber 14 and is driven by a crankshaft 42. The cooling fins 40 are not absolutely necessary, but are useful for cooling of the cylinder case 38, wherein other types of cooling of the cylinder case 38, which are not shown, for example by water cooling, often have a higher cooling capacity. Furthermore, an air inlet 30 with an air inlet valve 28, an air outlet 34 with an air outlet valve 32, and also a dead space (clearance volume) 16 with a valve unit 18, are shown. FIG. 5 shows a plurality of dead spaces 16 and valve units 18.

During an air induction phase, which is shown via arrows in FIG. 2, the piston 36 moves downward inside the piston chamber 14, wherein air is drawn into the piston chamber 14 through the air inlet valve 28 from the air inlet 30. In the induction phase, the air outlet valve 32 is closed as constructed. During the delivery phase, which is not shown, the piston 36 moves upwards in the piston chamber 14, wherein the air inlet valve 28 closes, the air outlet valve 32 opens upon achieving a sufficiently high pressure, and air is delivered to the air outlet 34.

If the valve unit 18 is operated, a connection is opened between the piston chamber 14 and the dead space 16, through which connection air can flow. The flow resistance in this case is essentially dependent upon the opened valve cross sectional area which operates the valve unit 18. If the compressor 10 is in a delivery phase, the air is not only compressed inside the piston chamber 14 but also in the dead space 16. The relative compression of the air is therefore reduced since the volume of the piston chamber 14 which is to be compressed is increased by that of the dead space if the valve unit 18 opens a sufficiently large valve cross section. If the opened valve cross section is not large enough, then it acts as a restrictor. In this case, the pressure which occurs during the compression is reduced less sharply.

If the volume of the dead space 16 and the valve cross section which is opened by the valve unit 18 exceed a specific limit, then the pressure which can be achieved in the piston chamber 14 during a delivery phase can be less than the pressure which prevails in the region of the air outlet 34. Air delivery then no longer takes place, wherein at the same time less work for compressing the air needs to be performed. In this way, an energy-economizing system for the charged compressor 10 can be realized.

Figure 3:
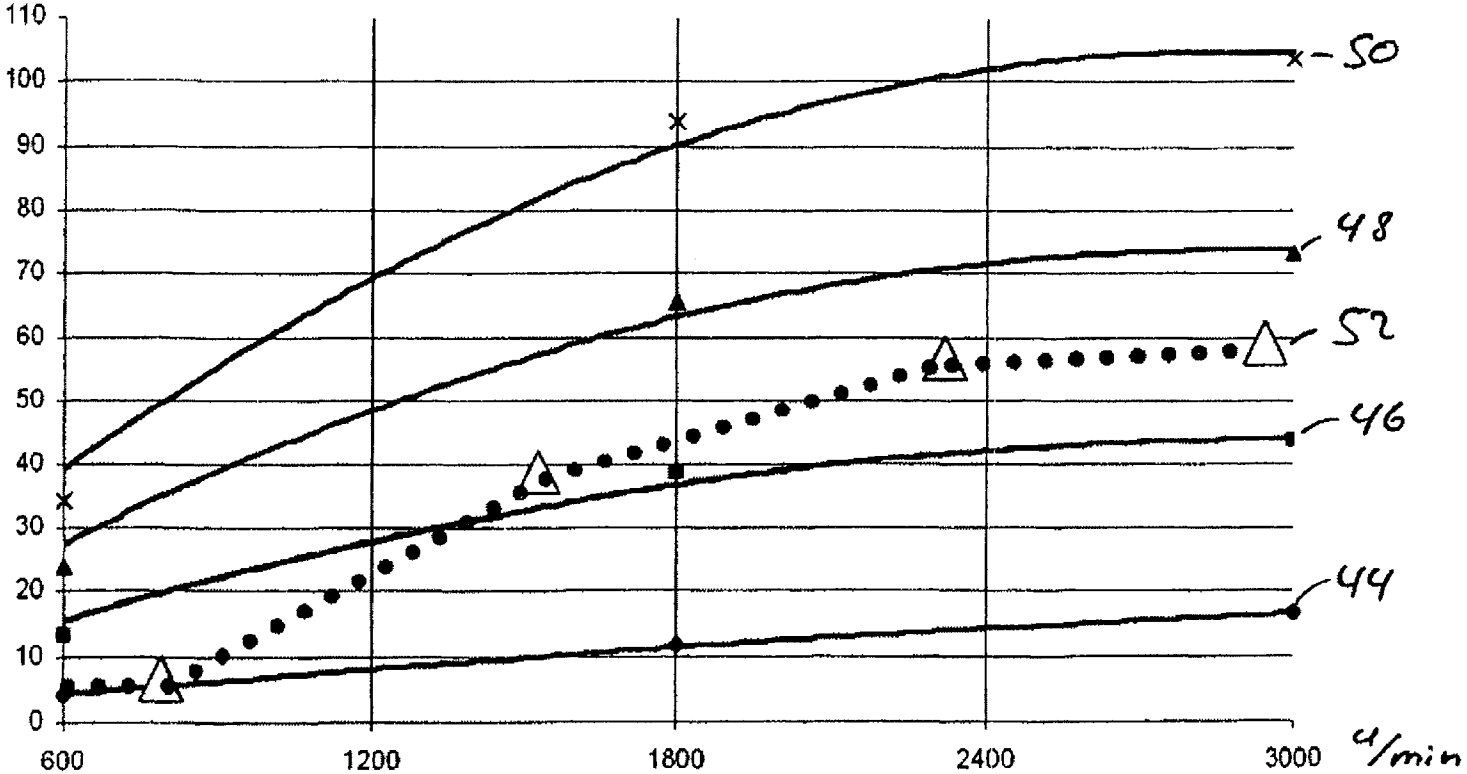
FIG. 3 is a graph showing the delivered air volume of a charged compressor according to the invention in dependence upon the charging pressure.

FIG. 3 shows the delivered air volume of a compressor 10 according to an exemplary embodiment of the invention in dependence upon the charging pressure. The continuous lines 44, 46, 48 and 50 are curves which are interpolated by the associated data points and which show the delivered air volume of a charged compressor in dependence upon the speed of the compressor. The curve 44 corresponds to the delivered air volume without turbocharging, that is to say a charging pressure of 0 psi. The curves 46, 48 and 50 correspond to charging pressures of 20 psi, 40 psi and 60 psi, respectively. Furthermore, dotted line 52 represents the measured delivered amount of air of a charged compressor according to an embodiment of the invention in dependence upon the speed of the compressor. In the lower region of this curve, between about 600 and 800 revolutions per minute, the curve 52 coincides with the curve 44. These speeds of the compressor 10 correlate with low speeds of the engine 20, during which the turbocharger 22 cannot develop any appreciable charging pressure. Between 800 and 3000 revolutions per minute, the delivered amount of air increases on account of the increasing charging pressure of the compressor 10, but levels off in the upper region upon reaching the maximum charging pressure of the turbocharger 22 which is used. It is to be taken into account that the charged compressor 10 delivers at least the same amount of air as an uncharged compressor, which is represented in the curve 44. In particular, during no-load (idle) operation at least the same amount of air can therefore be delivered as without turbocharging.

Figure 4:
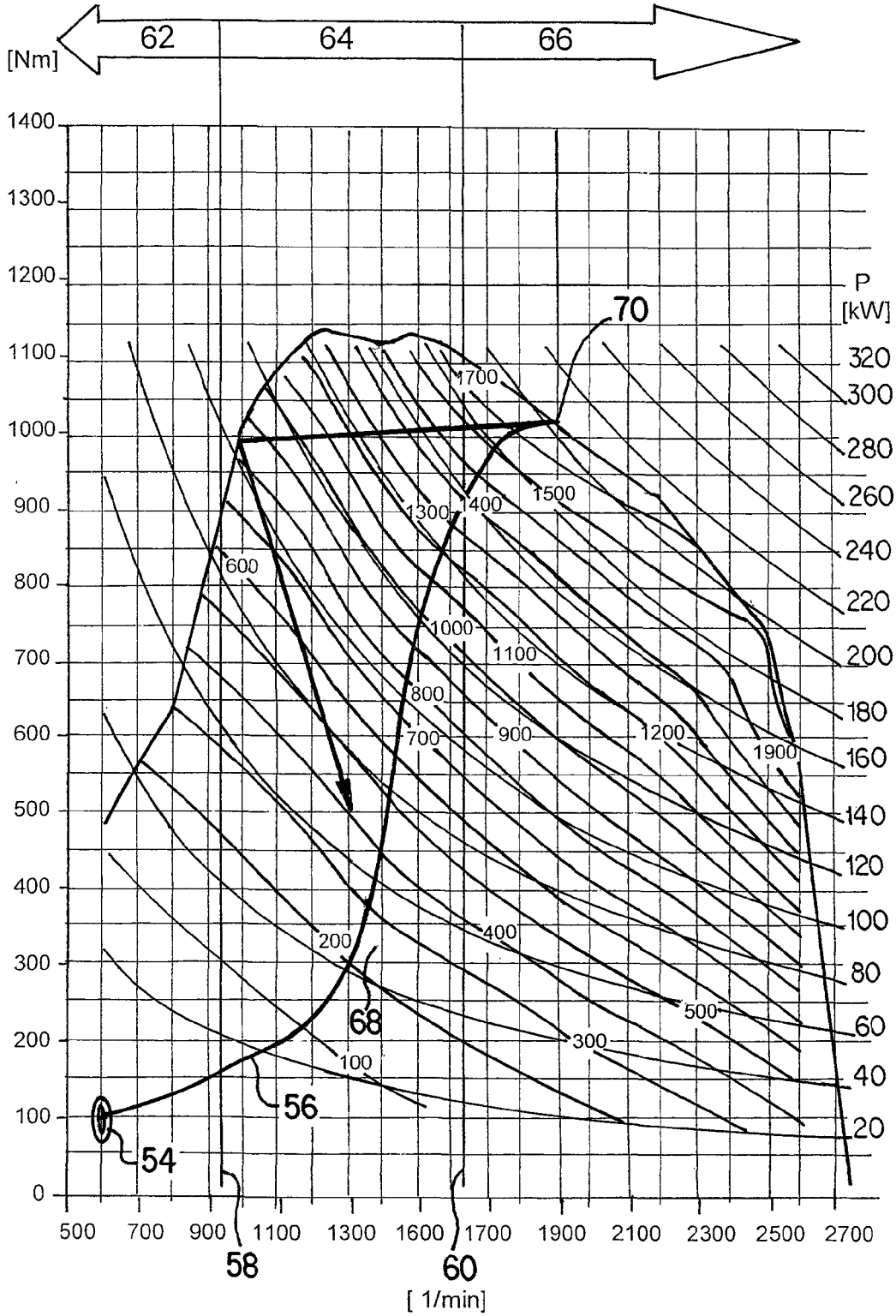
FIG. 4 is a graph showing an engine characteristic map with different operating ranges of a charged compressor according to the invention for illustrating the principle of operation of the method.

FIG. 4 shows an engine characteristic map with different operating ranges of a charged compressor for illustrating the principle of operation of the method according to the invention. The engine speed is customarily plotted on the x-axis, the torque which is delivered by the engine is customarily plotted on the y-axis, and lines of equal engine power, which extend from the right, are additionally plotted in the form of hyperbolas. Furthermore, lines of equal charging pressure in millibars are applied inside the engine characteristic map. A first operating range 62, a second operating range 64, and a third operating range 66 are separated by a first shift threshold 58 and a second shift threshold 60. The line 56 which is drawn in in bold type represents a measured curve of engine data, with reference to which the method is explained in the following.

In the first operating range 62 of the charged compressor, the dead space 16 is not engaged. In the second operating range 64, the dead space 16 is partially engaged by way of the valve unit 18, while in the third operating range 66, the dead space 16 is totally engaged or the clutch 72 is opened.

Starting from the no-load operation 54, the vehicle accelerates in the first operating range 62, wherein the state of the engine 20 moves through the engine characteristic map from lower left to upper right along the s-shaped curve 56. Upon reaching the first shift threshold 58, the dead space 16 is partially engaged in order to reduce the peak pressures which occur in the charged compressor 10 during compression of the air. With increasing engine speed, the charging pressures which are provided by the turbocharger 22 quickly increase and upon reaching the second shift threshold 60 the dead space 16 is totally engaged in order to once more reduce the peak pressures which occur inside the charged compressor 10, or the clutch 72 is opened and the compressor 10 is totally disengaged from the engine 20.

Upon reaching an upper shift point 70, the next-higher speed of a transmission, which is not shown, is engaged, wherein at the same time the speed of the engine 20 drops steeply. After re-engaging the transmission, the engine speed increases again to point 70. During the shift process, the curve 56 again crosses the second shift threshold 60, which is why the dead space 16 is partially disengaged again or the clutch 72 is closed again. It is to be taken into consideration that the first shift threshold 58 was selected so that it is crossed only once during the acceleration phase of the commercial vehicle 12. All subsequent processes take place in the second operating range 64 and in the third operating range 66. Upon reaching the final speed of the commercial vehicle 12, the engine 20 is customarily inside the normal operating range 68 which lies at a distance from the first shift threshold 58 and from the second shift threshold 60. It is furthermore contemplated to transfer the compressor into an energy-economizing state by engaging an additional dead space or by enlarging the free valve cross section.

TABLE OF REFERENCE NUMERALS

10 Compressor
12 Commercial vehicle
14 Piston chamber
16 Dead space
18 Valve unit
20 Engine
22 Turbocharger
24 Air filter
26 Junction point
28 Air inlet valve
30 Air inlet
32 Air outlet valve
34 Air outlet
36 Piston
38 Cylinder case
40 Cooling rib
42 Crankshaft
44 0 psi charging pressure
46 20 psi charging pressure
48 40 psi charging pressure
50 60 psi charging pressure
52 Measured values
54 No-load operation
56 Measured curve
58 First shift threshold
60 Second shift threshold
62 First operating range
64 Second operating range
66 Third operating range
68 Normal operating range
70 Shift point
72 Clutch The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A charged compressor for compressed air supply of a commercial vehicle, comprising:

a piston chamber of the compressor;

a dead space of the compressor; and a valve unit operatively configured for either connecting the piston chamber to an entire volume of the dead space or completely separating the piston chamber from the dead space, the valve unit being further operatively configured to reduce an air volume delivered by the charged compressor to a value different from zero by activating the dead space;

wherein the valve unit comprises a two-stage operable valve having a closed state, a first open state having a first opened valve cross section, and a second open state having a second opened valve cross section that is larger than the first opened valve cross section, the dead space is completely separated from the piston chamber when the valve unit is in the closed state, the dead space is partially engaged and the entire volume of the dead space is connected with the piston chamber when the valve unit is in the first open state, the dead space is totally engaged and the entire volume of the dead space is connected with the piston chamber when the valve unit is in the second open state, and the closed state, the first open state and the second open state are steady states, the first open state being maintained when an operating parameter is between two predetermined control thresholds.

2. The charged compressor according to claim 1, wherein the valve unit comprises a plurality of valves, at least one of which is individually operable.

3. The charged compressor according to claim 1, wherein the air volume delivered by the charged compressor is reducible to zero by engaging the dead space.

4. The charged compressor according to claim 1, further comprising a clutch operatively configured to disengage the compressor from an engine of the commercial vehicle.

5. A commercial vehicle, comprising: an air supply system, the air supply system including a charged compressor for supplying compressed air for the commercial vehicle, the charged compressor comprising:

a piston chamber of the compressor;

a dead space of the compressor; and a valve unit operatively configured for either connecting the piston chamber to an entire volume of the dead space or completely separating the piston chamber from the dead space, the valve unit being further operatively configured to reduce an air volume delivered by the charged compressor to a value different from zero by activating the dead space;

wherein the valve unit comprises a two-stage operable valve having a closed state, a first open state having a first opened valve cross section, and a second open state having a second opened valve cross section that is larger than the first opened valve cross section, the dead space is completely separated from the piston chamber when the valve unit is in the closed state, the dead space is partially engaged and the entire volume of the dead space is connected with the piston chamber when the valve unit is in the first open state, the dead space is totally engaged and the entire volume of the dead space is connected with the piston chamber when the valve unit is in the second open state, and the closed state, the first open state and the second open state are steady states, the first open state being maintained when an operating parameter is between two predetermined control thresholds.

6. A method for controlling a charged compressor supplying compressed air to a commercial vehicle, the charged compressor including a piston chamber, a dead space, and a valve unit, the valve unit comprising a two-stage operable valve operatively configured to engage the dead space, wherein the two stage operable valve has a closed state, a first open state having a first opened valve cross section, and a second open state having a second opened valve cross section that is larger than the first opened valve cross section, the method comprising the acts of:

delivering an air volume from the charged compressor; and controlling the valve unit to engage an entire volume of the dead space in order to reduce the air value delivered by the charged compressor to a value differing from zero by adjusting a cross section of the opened two-stage operable valve between the piston chamber and the dead space in two stages;

wherein the dead space is partially engaged and the entire volume of the dead space is connected with the piston chamber when the valve unit is in the first open state, the dead space is totally engaged and the entire volume of the dead space is connected with the piston chamber when the valve unit is in the second open state, and the closed state, the first open state and the second open state are steady states, the first open state being maintained when an operating parameter is between two predetermined control thresholds.

7. The method according to claim 6, wherein the air volume is reduced to zero by engaging the dead space.

8. The method according to claim 6, wherein at least one condition for engaging the dead space is fulfilled only during an acceleration phase of the commercial vehicle.

9. The method according to claim 6, wherein the act of controlling the valve unit to engage the dead space is carried out as a function of at least one of the following values:

engine speed, turbocharger speed, charging pressure of a turbocharger, engine load, and an air requirement of the commercial vehicle.

10. The method according to claim 6, further comprising the act of engaging a clutch to disengage the charged compressor from an engine of the commercial vehicle.

11. The method according to claim 10, wherein at least one condition for engaging the clutch is fulfilled only during an acceleration phase of the commercial vehicle.

12. The method according to claim 10, wherein the act of engaging the clutch is carried out as a function of at least one of the following values:

engine speed, turbocharger speed, charging pressure of a turbocharger, engine load, and an air requirement of the commercial vehicle.

13. The method according to claim 11, wherein the act of engaging the clutch is carried out as a function of at least one of the following values:

engine speed, turbocharger speed, charging pressure of a turbocharger, engine load, and an air requirement of the commercial vehicle.

* * * * *